United States Patent [19]

Lesley

[11] Patent Number: 4,517,685

[45] Date of Patent: May 21, 1985

[54] RETRO-REFLECTIVE ATTACHMENT FOR WEARING APPAREL

[75] Inventor: Gary M. Lesley, Mankato, Minn.

[73] Assignee: Head Lites Corporation, Mankato, Minn.

[21] Appl. No.: 483,192

[22] Filed: Apr. 8, 1983

Related U.S. Application Data

[63] Continuation-in-part of Ser. No. 399,826, Jul. 19, 1982, abandoned.

[51] Int. Cl.[3] ..... A41D 1/00; A42B 1/24

[52] U.S. Cl. ..... 2/170; 2/171; 2/DIG. 11; 2/202; 350/98

[58] Field of Search ..... 2/171, 170, 181, 422, 2/16, 22, 239, 202, 185 R, 199, 2; 350/98, 97; 119/106; 362/105, 106, 107

[56] References Cited

U.S. PATENT DOCUMENTS

| | | | |
|---|---|---|---|
| 1,886,753 | 11/1932 | Steinberger | 2/170 |
| 2,199,996 | 5/1940 | Hobson et al. | 350/98 X |
| 2,656,763 | 10/1953 | Frost . | |
| 2,787,236 | 4/1957 | Welch . | |
| 3,466,664 | 9/1969 | Militello . | |
| 3,577,561 | 5/1971 | Oshima . | |
| 3,837,007 | 9/1974 | Girest . | |
| 4,047,400 | 9/1977 | Thorneburg . | |
| 4,091,766 | 5/1978 | Colliard . | |
| 4,365,354 | 12/1982 | Sullivan | 2/171 X |
| 4,384,548 | 5/1983 | Cohn | 350/98 X |

FOREIGN PATENT DOCUMENTS 494421 10/1938 United Kingdom .

OTHER PUBLICATIONS

"Velcro" Product News, Nov. 1974, PN No. 8, p. 4.

*Primary Examiner*—Peter Nerbun

*Attorney, Agent, or Firm*—Merchant, Gould, Smith, Edell, Welter & Schmidt

[57] ABSTRACT

Retro-reflective material is secured to the exterior surface of an article of wearing apparel in a manner which maximizes the light-reflecting capability of the article. Specifically, the retro-reflective material is secured in a manner not requiring any add-on fasteners and which leaves the material ruffled or pleated. The invention increases the number of different surfaces available for gathering incident light rays and reflecting same back to the light source making the wearer more visible to the light source.

3 Claims, 7 Drawing Figures

FIG. 1
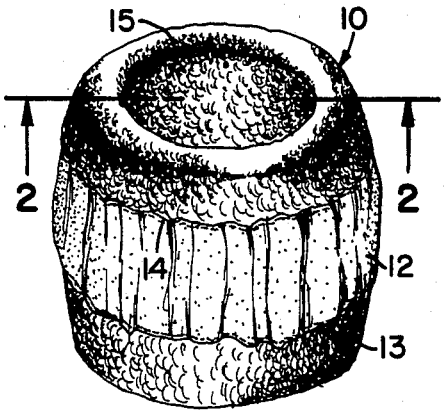
FIG. 2
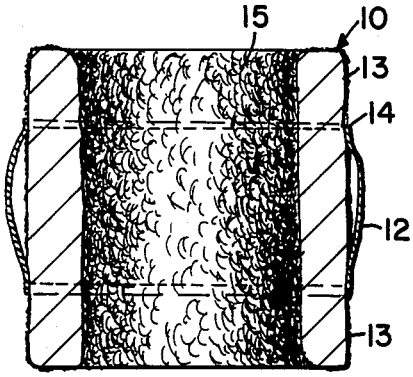
FIG. 3
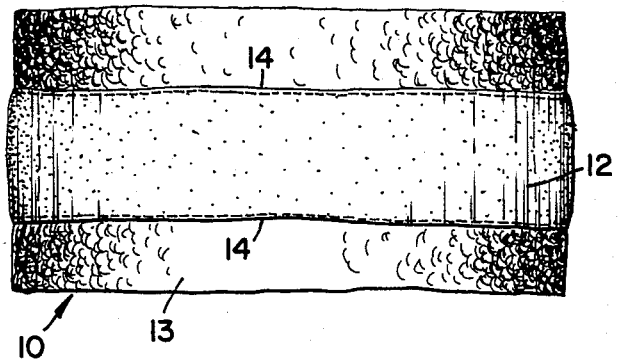
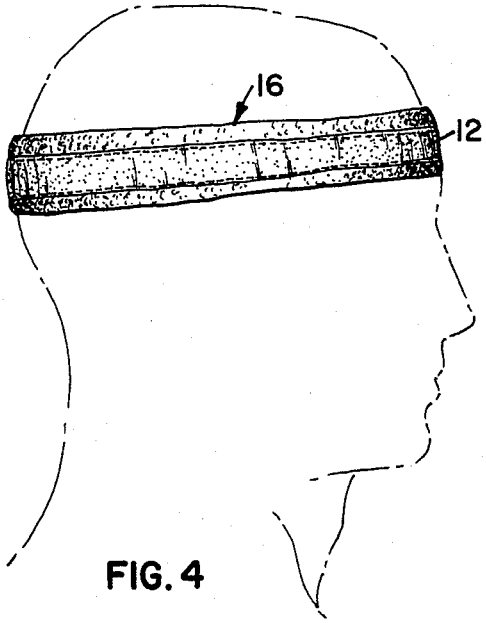
FIG. 4

FIG. 5
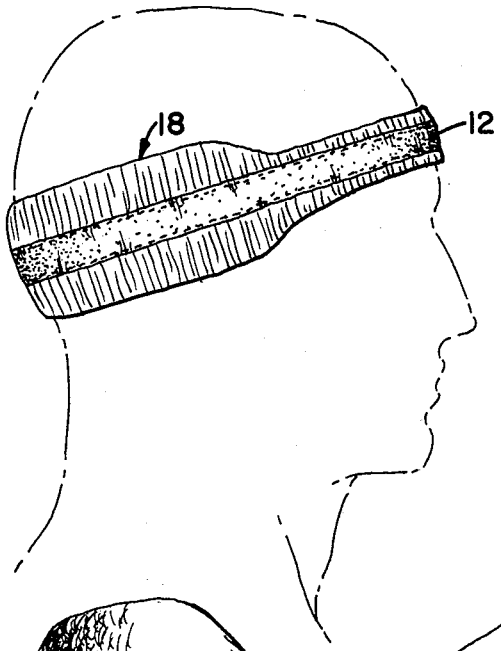
FIG. 7
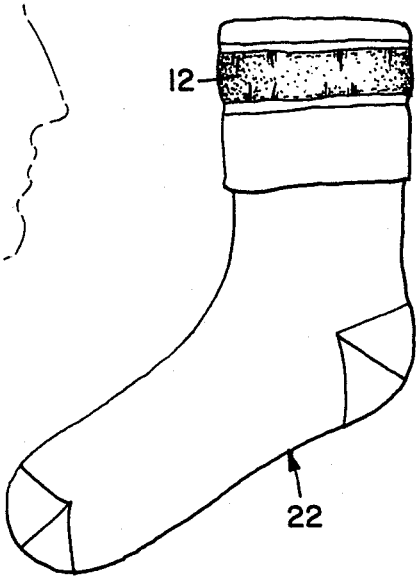
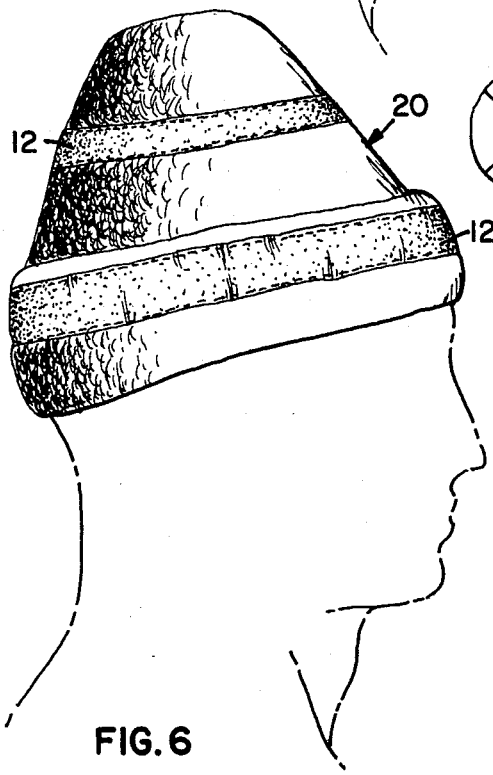
FIG. 6

RETRO-REFLECTIVE ATTACHMENT FOR WEARING APPAREL

CROSS REFERENCE TO RELATED APPLICATION

This application is a continuation-in-part of my pending application filed July 19, 1982, U.S. Ser. No. 399,826 now abandoned.

TECHNICAL FIELD

The present invention relates to devices which reflect light rays and in particular to an attachment for an article of wearing apparel having retro-reflective properties for increasing the visibility of the wearer at night.

BACKGROUND

Activities such as jogging, biking and walking undertaken at night or in a darkened area with limited visibility, require the participant to take sufficient precautions to insure he will be seen by the driver of a motor vehicle in order to avoid injury. With the increasing numbers of people who partake in outdoor activities at night, attempts have been made to provide items which will provide a degree of visibility which is not otherwise present. For example, reflective material has been used in the prior art such as thin, cloth bands variously attached at the wrist, ankle and head portions of the wearer. However, the resulting constructions of such prior art articles have been less than satisfactory in appearance as well as comfort and reliability. Oftentimes the material selected lacks absorbency or is difficult to work with. The reflective bands often are not properly applied to the article and thus are not as durable as is required for frequent use. Further, such prior art attempts have often yielded articles of wearing apparel which are lacking in aesthetic appeal and thus are not worn when needed to insure the safety of the nighttime runner or biker.

Subsequent attempts to improve on such products have included the use of reflective yarn in the manufacture of an article of clothing. However, reflective yarn often lacks adequate candle-power capability for reflecting sufficient light rays to alert a motorist in time to avoid hitting the person who is wearing the article.

Other types of safety devices used at night to alert oncoming traffic to the presence of a person include the use of pedal reflectors on a bicycle. The combination of reflectivity and movement of the reflectors provides a motor vehicle operator a visible point of reference and thus a collision may be avoided. However, such devices are of no use to a runner or person walking in the dark or to a person whose bicycle is not equipped with pedal reflectors.

To date, there remains a need for a lightreflective article which is comfortable, durable, stylish and effective in providing increased night safety to the wearer when in close proximity with operating motor vehicles.

SUMMARY

The present invention is an attachment for an article of manufacture worn on a portion of the body. The attachment includes retro-reflective material secured to the article in a manner which maximizes the amount of incident light rays capable of being reflected back to the source of light, e.g. a motor vehicle. A preferred construction of the invention is the use of an exposed lens, retro-reflective fabric which is preferably secured upon a stretchable article of clothing while the article is in a stretched condition. When the article of clothing containing the retro-reflective portion is relaxed to its unstretched state, the non-elastic retro-reflective portion takes on the appearance of being ruffled or pleated. This construction causes the retro-reflective fabric to project outwardly and bend back upon itself to accommodate the reduced size of the underlying article. In the invention the ruffled-effect increases the number of different surface areas available for incident light rays to be reflected thus increasing the degree to which the wearer is made visible to an oncoming motorist in the dark.

The articles of clothing may be sweatbands for the wrist or ankle, cuffed stockings, cold weather items such as earbands and stocking hats, as well as traditional articles such as pants.

BRIEF DESCRIPTION OF THE DRAWINGS

FIG. 1 is a perspective view of a sweatband incorporating the present invention in a preferred embodiment thereon.

FIG. 2 is a cross-sectional view of the sweatband as seen generally along lines 2—2 in FIG. 1.

FIG. 3 is a plan view of a sweatband stretched to its full length illustrating the securement of a retro-reflective portion thereon.

FIG. 4 is a side view of another article of wearing apparel incorporating the invention thereon.

FIG. 5 is a side view of a third article of wearing apparel incorporating the invention thereon.

FIG. 6 is a side view of a fourth article of wearing apparel incorporating the invention thereon.

FIG. 7 is a side view of a fifth article of wearing apparel incorporating the invention thereon.

DETAILED DESCRIPTION OF A PREFERRED EMBODIMENT OF THE PRESENT INVENTION

Referring now to FIGS. 1–3 a preferred embodiment of the present invention will be described in detail. To illustrate the preferred embodiment of the invention stretchable articles of wearing apparel have been selected. However, it will be appreciated that the invention is not necessarily limited solely to use on the stretchable articles illustrated herein. In FIG. 1 a sweatband 10 of the type well known to sports participants is shown. The sweatband 10 in this embodiment is made from a stretchable terry-cloth type of material. The stretchable material may be knitted or woven. Preferably the material is absorbent and able to accommodate various wrist and ankle sizes comfortably. As shown in FIG. 1 the sweatband 10 is in a relaxed state in which it is not stretched. FIG. 3 shows the same sweatband as it would appear when stretched to its maximum extension.

The sweatband 10 has a first length which may be the maximum circumference as measured when the band is fully stretched or extended or a length slightly less than the maximum circumference when the article is expanded but not fully stretched. In FIG. 2 only one side is shown which illustrates only one-half the maximum length or circumference. A second length or minimum circumference is measured when the band is in a relaxed, unstretched condition as shown in FIG. 1.

Retro-reflective fabric portions are applied to the band while it is in a fully stretched state. In the preferred embodiment the selected retro-reflective material 12 is SCOTCHLITE brand reflective fabric trim manufactured by Minnesota Mining and Manufacturing Co. of Minneapolis, Minn. SCOTCHLITE is a registered trademark of the same company. This particular brand of material 12 is an exposed lens fabric made by forming minute glass beads on the surface of the fabric. Of course suitable alternative retro-reflective materials may be used. The desired characteristics for the material include durability, sufficient candle-power capability to gather and reflect a maximum amount of available incident light rays and flexibility in the methods by which it can be attached to the article. The retro-reflective material may be of varying widths and colors.

To apply the retro-reflective material 12 to the article, in this case the sweatband 10, the article is stretched either to its maximum length or a suitable expanded condition. A strip of the retro-reflective material 12, substantially equal in length to the length or circumference of the stretched band, is sewn on the exterior surface 13 of the band. As shown in FIGS. 2 and 3 the material 12 is stitched to the underlying article the full length of the article's exterior side 13, along all free edges 14 of the material. This construction leaves the greater part of the retro-reflective material unattached to the underlying article. As can be seen in FIG. 2, the interior surface 15 remains free of any add-on items and thus the intended comfortable fit of the article is maintained despite the external alteration of the article by the invention. When the securement of the retro-reflective band to the stretched article is completed the article is released to allow it to return to its unstretched or relaxed condition.

With the article in its relaxed condition the retro-reflective material 12, which is generally not stretchable but is, however, flexible, must bend outwardly and pleat itself to accommodate the reduced surface area underlying it. The resulting appearance of the retro-reflective material becomes ruffled or accordian-like due to the length of the retro-reflective material 12 being greater than the circumference or length of the relaxed article of clothing to which it is attached. The retro-reflective material in this condition provides a non-flat area having a multiplicity of surfaces on which to gather incident light rays. Thus the invention is able to reflect a greater number of light rays back to the light source than is generally the case with the prior art reflective devices which provide a continuous flat surface for reflecting light.

Of course the invention can be embodied in other types of articles of wearing apparel and particularly in stretchable items. For example, FIG. 4 illustrates the invention as applied on a head sweatband 16, FIG. 5 a cold weather earband 18, FIG. 6 a stocking cap 20 and FIG. 7 a cuffed athletic stocking 22. In each case the article is first stretched to an expanded size and the retro-reflective portions secured on an exterior surface of the stretched article in accordance with the method described above. When the stretched article is allowed to return to its normal, relaxed condition the retro-reflective portion 12 self-pleats or ruffles itself to accommodate the reduced size of the underlying portion of the article to which it is secured. The number of retro-reflective portions secured to each article is determined by the size of the article and the amount of reflectivity desired by the wearer.

In use the invention provides an effective means for increasing the night-safety of participants in night-time activities where the participant may come into close proximity with an operating motor vehicle. The light from a motor vehicle headlight and any available ambient light illuminate the retro-reflective portions of the article making the presence of the wearer noticeable and thus avoidable. The visibility of the wearer is accentuated by the movement of the wearer and the increased reflectivity available from the multiplicity of retro-reflective surfaces provided along the length of the ruffled, non-flat retro-reflective portions. Essentially a pedal-effect similar to that resulting from bicycle pedal reflectors is achieved by the invention at various locations on the body, e.g. head, wrist, and ankle.

The present invention is a unique and significant advance over the prior art devices now generally used in night-time activities for reflecting the light of on-coming vehicles. The method for securing the retro-reflective material to the article insures the invention will not fall off or be lost as commonly happens with prior art products. As a result the wearer can perform the activity with the assurance that continued protection is provided so long as the article containing the invention is worn. The invention does not interfere with the intended comfortable fit of the article as no add-on hardware or securing devices are required, and it can be applied to the article in a manner which is aesthetically pleasing. Further, it is believed the invention provides greater reflection of light than articles of similar size using the reflective items presently known in the prior art.

It should be apparent from the foregoing that the invention is not limited to the specific embodiments described and shown in the drawings. Neither is the invention limited to use on a stretchable article of clothing. The invention may be practiced on non-stretchable articles and the advantages of the ruffled or pleated appearance may be obtained pursuant to the teachings of the invention contained herein. Thus, the scope of the invention is limited only by the scope of the claims which follow.

What is claimed is:

1. A band-like safety item for wear about a portion of the body, comprising:

an elastic band of absorbent material expandable between relaxed and stretched conditions, said band being of predetermined width and having inside and outside surfaces;

a flexible but substantially inelastic strip of retro-reflective material of predetermined length circumferentially secured about at least a portion of the outside surface of said band; and said retro-reflective strip being of substantially narrower width than said band and being secured along opposite edges thereof to said band while substantially fully stretched so that said strip is ruffled when said band is not fully stretched to enhance reflectivity and thus visibility of the wearer under conditions of poor visibility.

2. A band-like safety item for wear about a portion of the body, comprising:

an elastic band of absorbent material expandable between relaxed and stretched conditions, said band being of predetermined width and having inside and outside surfaces;

a flexible but substantially inelastic strip of retro-reflective material of predetermined length circumferentially secured completely about the outside surface of said band; and said retro-reflective strip being of substantially narrower width than said band and being sewn along opposite edges thereof to said band while substantially fully stretched so that said strip is ruffled when said band is not fully stretched to enhance reflectivity and thus visibility of the wearer under conditions of poor visibility.

3. A band-like safety item for wear about a portion of the body, constructed according to the method comprising the steps of:

providing an elastic band of absorbent material;

providing a flexible but substantially inelastic strip of retro-reflective material of relatively narrower width than said band;

substantially fully stretching the elastic band;

positioning the retro-reflective strip about the entire outside circumferential surface of the stretched band;

sewing the retro-reflective strip along opposite edges thereof to the stretched band; and allowing the band to relax so that the retro-reflective strip becomes ruffled when the band is not fully stretched to enhance reflectivity and thus visibility of the wearer under conditions of poor visibility.

* * * * *